US010297232B2

(12) United States Patent
Oh et al.

(10) Patent No.: US 10,297,232 B2
(45) Date of Patent: May 21, 2019

(54) SOURCE DRIVER

(71) Applicant: SILICON WORKS CO., LTD., Daejeon-si (KR)

(72) Inventors: Kwang Il Oh, Daejeon-si (KR); Soo Woo Kim, Daejeon-si (KR); Myung Yu Kim, Daejeon-si (KR); Young Bok Kim, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 216 days.

(21) Appl. No.: 14/642,965

(22) Filed: Mar. 10, 2015

(65) Prior Publication Data

US 2015/0255042 A1 Sep. 10, 2015

(30) Foreign Application Priority Data

Mar. 10, 2014 (KR) ..... 10-2014-0028009
Mar. 5, 2015 (KR) ..... 10-2015-0031103

(51) Int. Cl.
*G09G 5/18* (2006.01)
*G09G 3/20* (2006.01)

(52) U.S. Cl.
CPC ..... *G09G 5/18* (2013.01); *G09G 3/20* (2013.01); *G09G 2310/027* (2013.01); *G09G 2310/0291* (2013.01); *G09G 2310/0297* (2013.01); *G09G 2330/021* (2013.01); *G09G 2330/028* (2013.01); *G09G 2370/08* (2013.01)

(58) Field of Classification Search
None
See application file for complete search history.

(56) References Cited

U.S. PATENT DOCUMENTS

2005/0122303 A1* 6/2005 Hashimoto ..... G09G 3/3688 345/98
2006/0022929 A1* 2/2006 Hashimoto ..... G09G 3/2011 345/96
2006/0092114 A1* 5/2006 Izumikawa ..... G09G 3/3648 345/89
2007/0273682 A1 11/2007 Yi et al.
2009/0040244 A1 2/2009 Lee et al.
2011/0074763 A1* 3/2011 Zhou ..... G06F 1/3203 345/212

(Continued)

FOREIGN PATENT DOCUMENTS

CN 1170186 1/1998
CN 1346123 4/2002

(Continued)

*Primary Examiner* — Joseph R Haley
*Assistant Examiner* — Emily J Frank
(74) *Attorney, Agent, or Firm* — Kile Park Reed & Houtteman PLLC

(57) ABSTRACT

Provided are a display device and a source driver. The source driver may perform a power down mode in response to any one of a vertical blank period, a horizontal blank period, a state in which the load of a panel is maintained at a preset value or less, a state in which a current supplied to the panel is maintained at a preset value or less, or a state in which resolution is maintained at a preset value or less. The source driver can realize the power down mode using various power options, thereby reducing power consumption.

19 Claims, 5 Drawing Sheets

(56) References Cited

U.S. PATENT DOCUMENTS

| | | | | |
|---|---|---|---|---|
| 2014/0121787 | A1* | 5/2014 | Yamazaki | H04L 12/2825<br>700/19 |
| 2014/0198138 | A1* | 7/2014 | Nambi | G09G 3/36<br>345/690 |
| 2016/0163245 | A1* | 6/2016 | Mu | G09G 3/20<br>345/212 |

FOREIGN PATENT DOCUMENTS

| | | |
|---|---|---|
| CN | 1728230 | 2/2006 |
| CN | 1766979 | 5/2006 |
| CN | 102034445 | 4/2011 |
| CN | 102270423 | 12/2011 |
| KR | 10-0993813 | 11/2010 |
| KR | 10-2011-0132126 | 12/2011 |
| KR | 10-2013-0051182 | 5/2013 |

* cited by examiner

SOURCE DRIVER

BACKGROUND

1. Technical Field

The present disclosure relates to a display device, and more particularly, to a source driver which provides a power down mode.

2. Related Art

Recently, a variety of display devices have been developed, including a liquid crystal display (LCD) device, a light emitting diode (LED) display device, an organic LED (OLED) display device and the like.

The display device includes various parts such as a gate driver, a source driver, a timing controller, and a power circuit, in order to express an image on a display panel.

The source driver of the display device may have various power options for an internal operation. However, the above-described power options are applied in a fixed state at all times, without considering a change of time or environment.

The source driver may consume a large amount of current due to the fixed power options, even when a large amount of current does not need to be supplied due to a change in load state or resolution of the display panel.

As described above, the source driver may consume a large amount of current regardless of the change in load state or resolution of the display panel. Thus, the display device consumes an unnecessary current.

In general, when a display panel is driven, the display panel needs to be charged at each predetermined time period in order to retain a cell voltage, before the cell voltage stored in a cell having a capacitor is discharged. With the improvement in characteristic of a switching element (thin film transistor (TFT)) forming the cell, the leakage characteristic of cell current of the display panel has been improved. Thus, when a refresh cycle is shortened to compensate for cell current leakage, current consumption may unnecessarily occur.

SUMMARY

Various embodiments are directed to a source driver which provides a power down mode in which a small amount of current is used, and provides a method for performing a power down mode and various power options, thereby reducing power consumption.

Also, various embodiments are directed to a source driver which performs a power down mode in which a smaller amount of current is consumed than a normal mode in which an active line for expressing an image is driven, in response to a state in which a display device can be driven by a small amount of current, such as a vertical blank period, a horizontal blank period, a state in which the load of a panel is maintained at a preset value or less, a state in which a current supplied to the panel is maintained at a preset value or less, or a state in which resolution is maintained at a preset value or less.

Also, various embodiments are directed to a source driver which regulates an output of a source driving signal for refresh by controlling an output buffer or multiplexer, in order to reduce current consumption caused by a refresh operation for a display panel after entering the power down mode.

In an embodiment, a source driver may include: an interface unit configured to recover data and mode select data from input data; a signal processing unit configured to output an analog voltage corresponding to the data and use a gamma voltage to generate the analog voltage; an output unit configured to output a source driving signal corresponding to the analog voltage; a bias unit configured to provide a driving voltage required for the operations of the interface unit, the signal processing unit, and the output unit, and provide the gamma voltage to the signal processing unit; and a control unit configured to provide a power control signal for distinguishing between a normal mode and a power down mode consuming a lower current than the normal mode, by referring to one or more of the mode select data and a mode control signal provided from outside. One or more of the interface unit, the signal processing unit, the output unit, and the bias unit may perform the power down mode corresponding to the power control signal.

In an embodiment, a source driver may include: a power save block configured to perform a digital operation for data transmission corresponding to input data; a power control block configured to generate an analog voltage by converting a digital signal provided as a result of the digital operation, and perform an analog operation for generating a source driving signal using the analog voltage; and a control unit configured to provide a power control signal for performing a power down mode by referring to one or more of mode select data contained in the data packet and a mode control signal provided from outside, and one or more of the power save block and the power control block perform the power down mode consuming lower power than a normal mode, according to the power control signal.

DETAILED DESCRIPTION

Figure 1:
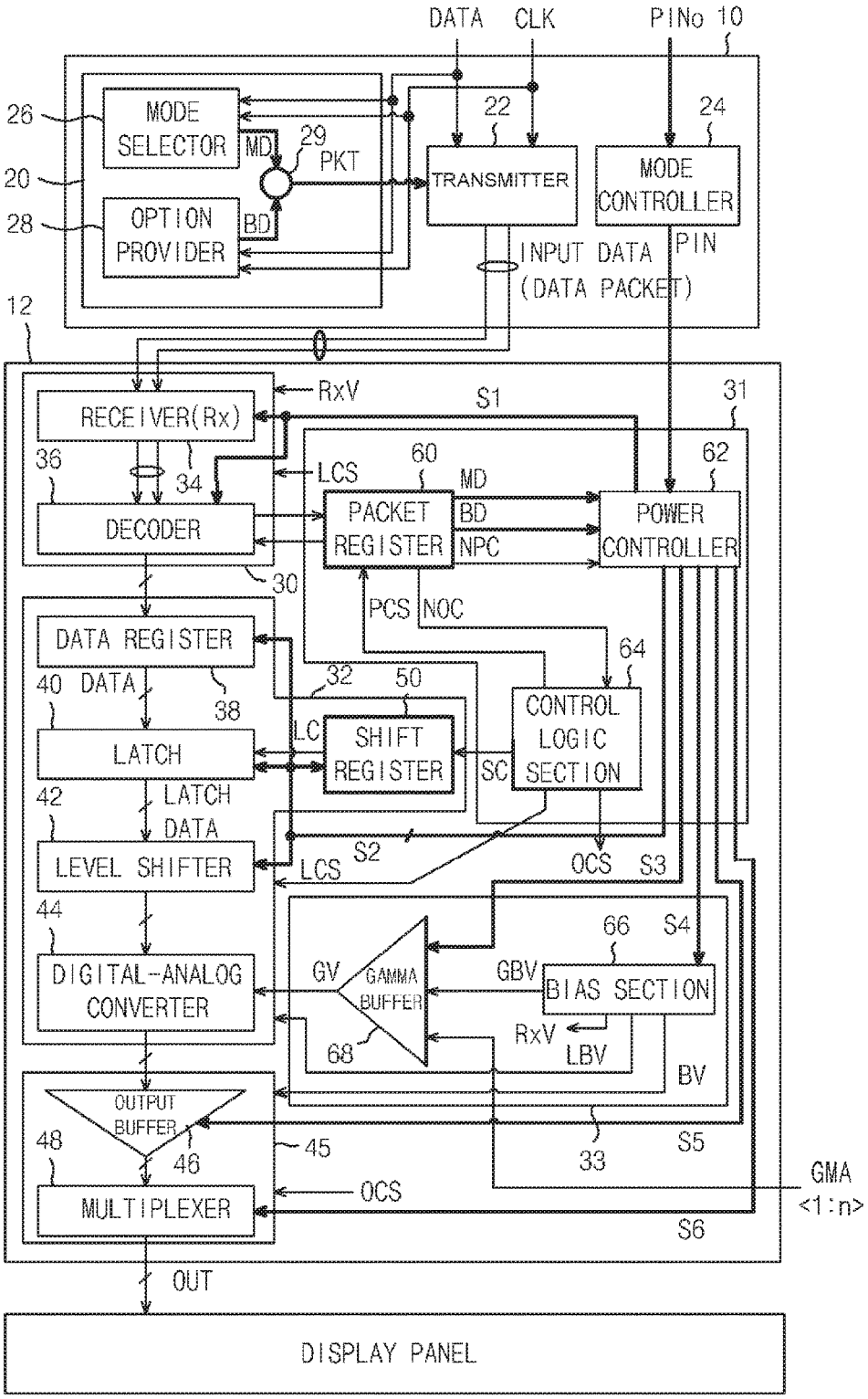
FIG. 1 is a block diagram of a source driver according to an embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

The exemplary embodiments of the present invention disclose a source driver for setting a period in which current consumption can be reduced according to an environmental change of a display panel, such as a load change, and preventing unnecessary current consumption by performing a power down mode at this period.

The period in which the power down mode is performed may include a vertical blank period, a horizontal blank period, a state in which the load of a display panel is maintained at a preset value or less, a state in which a current supplied to the display panel is maintained at a preset value or less, and a state in which the resolution of the display panel is maintained at a preset value or less.

Furthermore, the source driver in accordance with the embodiments of the present invention may reduce current consumption caused by a refresh operation of the display panel, after entering the power down mode. For this operation, the source driver may regulate an output of a source driving signal for refresh by controlling an output buffer or multiplexer in response to the power down mode, and control a switching state of an output buffer which drives a source driving signal OUT in the power down mode or a multiplexer which transmits the source driving signal OUT of the output buffer to the display panel. At this time, the output buffer may be turned off or maintain an output of the previous data. When the output buffer is turned off, the output buffer may be set in a state where an output thereof is floated. Furthermore, switching elements which are included in the multiplexer so as to transmit the source driving signal OUT may be turned off or floated.

According to the control of the output buffer and the multiplexer, corresponding to the power down mode, the source driving signal OUT of the source driver may maintain the previous data or be controlled in a floating state, regardless of input data.

The period in which the power down mode is performed may be defined using power control information PKT or a mode control signal PINo provided to a timing controller from outside. The power control information PKT and the mode control signal PINo will be described below.

The period in which the power down mode is performed is not limited to the above-described case, but can be selected as various cases by a manufacturer.

The display device may express an image by driving frames at a cycle of several tens of Hz. Each of the frames may include a plurality of horizontal lines which are determined according to resolution. Between the respective frames, a no-data period may exist. The no-data period may be referred to as the above-described vertical blank period. Furthermore, between the respective horizontal lines, a no-data period may also exist. The no-data period may be referred to as the above-described horizontal blank period. Hereafter, the horizontal line in accordance with the embodiment of the present invention will be referred to as an active line.

In the embodiments of the present invention, the case in which the power down mode is performed in response to a vertical blank period will be taken as an example for description.

In the embodiments of the present invention, a state in which an image is expressed by the above-described frame or active line will be referred to as a normal mode, and a state in which the display device is driven at low power in response to a vertical blank period or the like will be referred to as the above-described power down mode.

The display device in accordance with the embodiment of the present invention may provide various power options for the normal mode and the power down mode, and the source driver may be driven according to the above-described power options. In particular, according to the power option corresponding to the power down mode, the source driver may be disabled or operated at a low driving voltage or low frequency. When the source driver is disabled, a driving voltage may be set to 0, or a frequency may be set to 0 because a clock signal is masked. The power options may be equally applied to the entire source driver, or differently applied to components embedded in the source driver. For example, the power option corresponding to the power down mode may be divided for a power save block and a power control block which will be described below.

The source driver provided in the display device may be implemented with an integrated circuit, and the components embedded in the source driver may be divided into the power save block and the power control block. The power save block may include a shift register, a data register, or a latch unit which performs a digital operation. Furthermore, the power control block may include a receiver Rx, a gamma buffer, an output buffer, a multiplexer, or a bias unit, which performs an analog operation.

In response to the power down mode, the power options of the power save block and the power control block may be controlled in various manners.

That is, in response to the power down mode, the power save block may be operated at a low frequency or disabled by gating or masking a clock signal and a data signal, thereby reducing power consumption. More specifically, the power option of the power save block, corresponding to the power down mode, may be provided as a state in which the clock signal and the data signal are maintained at a low frequency or a low bias state in which a reduced dynamic current flows.

Unlike the power option of the power save block, the power option of the power control block, corresponding to the power down mode, may be provided as any one of a state in which the power control block biases a low voltage, a state in which the power control block is disabled to 0V, a state in which the power control block maintains the previous value, a floating state, and a normal state. The gamma buffer or bias unit may receive a power option for any one of a state in which the gamma buffer or bias unit biases a low voltage, a state in which the gamma buffer or bias unit is disabled to 0V, and a normal state, and the output buffer may receive a power option for any one of a state in which the output buffer maintains the previous value and a state in which the output buffer is floated. Furthermore, the multiplexer may receive a power option for turning off or floating a switching element, in order to block the source driving signal OUT from being transmitted to the display panel.

The display device according to an embodiment of the present invention may include a timing controller 10 and a source driver 12.

The timing controller 10 may be configured to receive data DATA of an external data source, a clock signal CLK, and a mode control signal PINo inputted through a terminal such as a pin or channel. Furthermore, the timing controller 10 may be configured to provide input data INPUT DATA formed in a data packet type and a mode control signal PIN to the source driver 12. The timing controller 10 may generate the power control information PKT by referring to power-related information provided from outside or generate the power control information PKT by determining the state of the data DATA. The generated power control information PKT may be contained in the data packet-type input data and then transmitted.

More specifically, the timing controller 10 may include a power control unit 20, a transmitter 22, and a mode controller 24, and the power control unit 20 may include a mode selector 26, an option provider 28, and an output unit 29.

In the above-described configuration, the transmitter 22 may receive data DATA and a clock signal CLK which are provided from outside, and generate a data packet DATA PACKET including the data DATA, the clock signal CLK, and a control signal. The control signal may include signals which are generated for control according the clock signal CLK and the power control information PKT which is provided from the power control unit 20. The signals which are generated for control and included in the control signals may include various signals required for driving the source driver 12, such as normal mode select data NPC which will be described below.

The timing controller 10 may transmit the data DATA, the clock signal CLK, and the control signal to a receiver 34 of the source driver 12 in various manners. Furthermore, the timing controller 10 may generate input data INPUT DATA in the form of a data packet including the data DATA, the clock signal CLK, and the control signal, and transmit the input data INPUT DATA through the transmitter 22.

The transmitter 22 may form various types of data packets DATA PACKET and transmit the data packets DATA PACKET as input data INPUT DATA. In the input data INPUT DATA, sections in which no data exists may periodically include the clock signal CLK.

The output unit 29 of the power control unit 20 may be configured to provide the power control information PKT, obtained by combining mode select data MD provided from the mode selector 26 and bias option data BD provided from the option provider 28, to the transmitter 22. The mode selector 26 and the option provider 28 may generate the mode select data MD and the bias option data BD by referring to the power-related information provided from outside or generate the mode select data MD and the bias option data BD by determining the state of the data DATA.

At this time, the output unit 29 may output (m+n)-bit power control information PKT obtained by combining m-bit mode select data MD provided from the mode selector 26 and n-bit bias option data BD provided from the option provider 28. Here, m and n may be defined as natural numbers.

More specifically, when the mode selector 26 provides one-bit mode select data MD of '1' and the option provider 28 provides three-bit bias option data BD of '001', the power control information PKT may be outputted as a value obtained by applying the value of the mode select data MD to the first bit thereof and applying the bias option data BD to the second to fourth bits thereof. That is, the output unit 29 may generate four-bit power control information PKT of '1001'.

Furthermore, the mode selector 26 may provide mode select data MD which is enabled in response to a vertical blank period. The mode selector 26 may provide the mode select data MD using the power control information PKT contained in the data DATA provided from outside. The mode select data MD may be outputted at a logical high level or as a binary value of '1', in order to be enabled in response to the vertical blank period.

Furthermore, the mode selector 26 may provide mode select data MD which is enabled at a preset time regardless of the input data INPUT DATA. In this case, in response to the power down mode, the source driving signal OUT of the source driver 12 may maintain the previous data regardless of the input data INPUT DATA or be controlled in a floating state.

The option provider 28 may provide bias option data BD which defines a power option for adjusting a bias corresponding to the power down mode. The option provider 28 may provide the bias option data BD using the power control information PKT contained in a data signal provided from outside. That is, the bias option data BD may have information for performing various power options for the power down mode.

The mode controller 24 may provide a mode control signal PIN which is enabled in response to a vertical blank period. The mode controller 24 may provide the mode control signal PIN by referring to a control signal such as a pin option provided from outside the timing controller 10 or information stored in an external register. Furthermore, the mode controller 24 may provide a mode control signal PIN corresponding to a vertical blank period or a mode control signal PIN for performing the power down mode at a preset time regardless of the input data INPUT DATA, by referring to a control signal provided from an internal component which is formed separately from the power control unit 20 according to a manufacturer's need.

In the above-described configuration of the timing controller 10, the mode select data MD of the mode selector 26 and the mode control signal PIN of the mode controller 24 may be provided using different source signals.

The mode controller 24 may provide the mode control signal PIN using a source having a higher priority than used in the mode selector 26. Thus, the mode control signal PIN may have an interrupt function for the power down mode based on the mode select data MD. That is, when the mode control signal PIN is activated, the power down mode based on the bias option data BD may be performed regardless of the value of the mode select data MD.

As described above, the mode select data MD and the mode control signal PIN may be defined as a signal for enabling a power down mode in a low power state.

In the present embodiment, the timing controller 10 may start operation in the power down mode, when receiving the mode select data MD from outside.

The timing controller 10 according to the embodiment of the present invention may provide the mode select data MD contained in the input data INPUT DATA or the mode control signal PIN of the mode controller 24 to the source driver 12. Thus, the source driver 12 may perform the power down mode according to the mode select data MD or the mode control signal PIN at a vertical blank period.

The source driver 12 may be configured to recover the data DATA and the clock signal CLK, contained in the input data INPUT DATA, and then generate and output a source driving signal OUT.

The source driver 12 may include an interface unit 30, a control unit 31, a signal processing unit 32, a bias unit 33, and an output unit 45.

The interface unit 30 may include a receiver 34 and a decoder 36. The interface unit 30 may be configured to receive the input data INPUT DATA provided from the timing controller 10 and recover the data DATA, the clock signal CLK, and the power control information PKT from the data packet DATA PACKET of the input data INPUT DATA.

More specifically, the receiver 34 may receive the input data INPUT DATA, and correct the input data INPUT DATA into a level which can be received by the decoder 36.

The decoder 36 may recover the data DATA using the input data INPUT DATA in a data packet type, recover the clock signal CLK, and recover the control signal including the power control information PKT. The decoder 36 may recover the clock signal CLK using a phase locked loop (PLL) or delay locked loop (DLL).

Furthermore, the decoder 36 may recover the data DATA and the control signal which are contained in the input data, using the recovered clock signal CLK. As the control signal is recovered, the power control information PKT may be recovered. Since the method for recovering the control signal can be implemented in various manners by a manufacturer, the detailed descriptions thereof are omitted herein.

The signal processing unit 32 may include a data register 38, a latch 40, a level shifter 42, a digital-analog converter 44, and a shift register 50, and output an analog voltage for generating a source driving signal OUT corresponding to the data DAT, using a gamma voltage GV.

Among the components, the data register 38 may be configured to temporarily store the data DATA provided from the decoder 36, and then output the stored data.

The latch 40 may be configured to latch the data DATA provided from the data register 38, and output the latch data LATCH DATA according to a latch control signal LC.

The level shifter 42 may be configured to receive the latch data LATCH DATA of the latch 40, and shift the level of the latch data LATCH DATA such that the digital analog converter 44 can process the latch data.

The data DATA may have a value representing a gray scale to be expressed as an image. The digital-analog converter 44 may be configured to output an analog voltage having a voltage level corresponding to the value of the latch data LATCH DATA. At this time, the digital-analog converter 44 may select and output a gamma voltage GV corresponding to the value of the latch data LATCH DATA.

The shift register 50 may be configured to receive a shift control signal SC from a control logic section 64 which will be described below, and provide the latch control signal LC corresponding to the shift control signal SC to the latch 40.

Although not illustrated, the data register 38, the latch 40, the level shifter 42, and the shift register 50 may perform an operation in synchronization with the clock signal CLK recovered by the decoder 36, and the operation synchronized with the clock signal CLK may be performed according to a logic control signal LCS of the control logic section 64 which will be described below.

As described above, the signal processing unit 32 may be configured to output an analog voltage corresponding to the data DATA.

The output unit 45 may include an output buffer 46 and a multiplexer 48. The output buffer 46 may be configured to output the source driving signal OUT by driving an analog voltage outputted from the digital analog converter 44 in response to the input data INPUT DATA, and the multiplexer 48 may be configured to switch an operation of providing the source driving signal OUT of the output buffer 46 to the display panel. At this time, the output buffer 46 may provide a pair of source driving signals OUT having different polarities, and the multiplexer 48 may alternately select and output the source driving signals OUT having different polarities. For the above-described operation, the output unit 45 may receive the output control signal OCS from the control logic section 64, and the output control signal OCS may include a source enable signal SOE for driving the output buffer 46 and a switching control signal for the switching operation of the multiplexer 48.

The bias unit 33 may include a bias section 66 and a gamma buffer 68. The bias section 66 may provide a receive bias voltage RxV to the interface unit 30, provide a logic bias voltage LBV to the signal processing unit 32, provide a bias voltage BV required for driving the output buffer 46 and the multiplexer 48 to the output unit 45, and provide the gamma bias voltage GBV to the gamma buffer 68.

The receive bias voltage RxV may include various levels of voltages required for the operations of the receiver 34 and the decoder 36. In particular, a driving voltage and a low bias voltage which are provided for the operations of the receiver 34 and the decoder 36 may be included in the receive bias voltage RxV. The logic bias voltage LBV may include various levels of voltages required by the data register 38, the latch 40, the level shifter 42, the digital-analog converter 44, and the shift register 50.

The gamma buffer 68 may be configured to provide the gamma voltage GV corresponding to gamma control data GMA<1:n> to the digital-analog converter 44 using the gamma bias voltage GBV of the bias section 66. The gamma control data GMA<1:n> may include a control signal provided from outside.

The control unit 31 may include a packet register 60, a power controller 62, and a control logic section 64.

Among the components, the packet register 60 may be configured to receive and store the control signal recovered by the decoder 36 and provide a control signal required for the operation of the decoder 36. The control signal required for the operation of the decoder 36 may include information required for recovering a clock signal and data. The control signal recovered by the decoder 36 may include mode select data MD, bias option data BD, normal mode select data NPC, and normal operation control data NOC. The normal mode select data NPC may be activated in response to the normal mode. The normal operation control data NOC may define the state of the logic control signal LCS outputted from the control logic section 64 in response to the normal mode. The packet register 60 may provide the mode select data MD, the bias option data BD, and the normal mode select data NPC to the power controller 62, and provide the normal operation control data NOC to the control logic section 64. The packet register 60 may receive a packet control signal PCS from the control logic section 64, and control the output of the mode select data MD, the bias option data BD, and the normal mode select data NPC and the providing of the control signal required for the operation of the decoder 36.

The power controller 62 may be configured to output power control signals S1 to S6 to which any one of the bias option data BD and the normal mode select data NPC is applied, by referring to the mode select data MD of the packet register 60 and the mode control signal PIN of the mode controller 24. That is, the power controller 62 may activate the power down mode according to any one of the mode select data MD and the mode control signal PIN. The power controller 62 may be configured to provide power control signals S1 to S6 to which the bias option data BD is applied, in response to the power down mode, or provide power control signals S1 to S6 to which the normal mode select data NPC is applied, in response to the normal mode.

The power controller 62 may be configured to provide the power control signal S1 to the receiver 34 and the decoder 36, provide the power control signal S2 to the power save block including the data register 38, the latch 40, the level shifter 42, and the shift register 50, provide the power control signal S3 to the gamma buffer 68, provide the power control signal S4 to the bias section 66, provide the power control signal S5 to the output buffer 46, and provide the power control signal S6 to the multiplexer 48. Each of the power control signals S1 to S6 may include a single bit or a plurality of bits, and have the same power option or a different power option.

More specifically, the power control signal S2 may be provided to select a state in which the frequencies of the clock signal and the data are controlled or a low bias state in which a reduced dynamic current flows. Furthermore, the power control signals S1, S3, and S4 provided to the receiver 34, the decoder 36, the bias section 66, and the gamma buffer 68, which are included in the power control block, may provide a power option corresponding to any one of a state in which the power control block biases a low voltage, a state in which the power control block is disabled to 0V, a state in which the power control block maintains the previous value, a floating state, and a normal state. Furthermore, the power control signal S5 provided to the output buffer 46 which is included in the power control block may provide a power option for any one of a state in which the previous value is maintained and a floating state. Furthermore, the power control signal S6 provided to the multiplexer 48 may provide a power option for selecting a switching state in which the switching element of the multiplexer 48 is turned off or floated, in order to block the source driving signal OUT of the output buffer 46 from being transmitted to the display panel.

The control logic section 64 may be configured to provide a logic control signal LCS to the interface unit 30 and the signal processing unit 32, provide a shift control signal SC to the shift register 50, and provide a packet control signal PCS to the packet register 60. The logic control signal LCS may include signals for controlling the operations of the respective units, and include signals which are commonly or independently provided to the respective units.

In the above-described configuration, the interface unit 30, the signal processing unit 32, the bias unit 33, and the output unit 45 may perform operation corresponding to the normal mode or power down mode.

The embodiment of the present invention may be configured as illustrated in FIG. 1. Referring to FIG. 1, the operation of the display device and the source driver 12 according to the embodiment of the present invention will be described as follows.

The timing controller 10 may perform the power down mode in response to a vertical blank period, and perform the normal mode when exiting from the vertical blank period.

The mode selector 26 may recognize the normal mode or the power down mode by referring to the data DATA and the clock signal CLK which are provided from outside. The data DATA may include control data. At this time, the control data included in the data DATA may be referred to when recognizing the normal mode and the power down mode. The mode selector 26 may provide the mode select data MD in an inactive state when the current state is recognized as the normal mode, and provide the mode select data MD in an active state when the current state is recognized as the power down mode. Since the mode selector 26 for recognizing the normal mode and the power down mode can be easily designed by those skilled in the art, the detailed descriptions thereof are omitted herein.

The mode controller 24 may recognize the normal mode or the power down mode according to an external control signal. In the normal mode, the mode controller 24 may provide the mode control signal PIN in an inactive state. In the power down mode, the mode controller 24 may provide the mode control signal PIN in an active state.

The option provider 28 may provide bias option data BD for performing a power option corresponding to the power down mode by referring to the data DATA and the clock signal CLK which are provided from outside. At this time, the bias option data BD may be set by referring to the control data included in the data DATA.

In the normal mode, the timing controller 10 may provide a logic low level or binary number of "0" as the mode select data MD or provide a low level signal as the mode control signal PIN.

In response to the above-described normal mode, the power controller 62 may generate power control signals S1 to S6 according to the normal mode select data NPC, and provide the power control signals S1 to S6 to the interface unit 30, the signal processing unit 32, the output unit 45, and the bias unit 33. At this time, the control logic section 64 may provide a logic control signal LCS for the operation of the normal mode to the interface unit 30 and the signal processing unit 32 by referring to the normal operation control data NOC, and provide an output control signal OCS for the operation of the normal mode to the output unit 45.

Thus, the interface unit 30, the signal processing unit 32, the output unit 45, and the bias unit 33 may be operated in a normal voltage environment corresponding to the normal mode, while receiving the data DATA, the clock signal CLK, and the control signal, outputting the source driving signal OUT using the recovered data DATA and the received clock signal CLK, providing the gamma voltage GV for the source driving signal OUT, and providing the receive bias voltage RxV, the logic bias voltage LBV, and the bias voltage BV.

When the vertical blank period is started, the source driver 12 may perform the power down mode.

That is, in response to the power down mode, the timing controller 10 may provide a logic high level or binary number of "1" as the mode select data MD or provide a high level signal as the mode control signal PIN.

In response to the above-described power down mode, the power controller 62 may generate power control signals S1 to S6 by referring to the bias option data BD, and provide the power control signals S1 to S6 to the interface unit 30, the signal processing unit 32, the output unit 45, and the bias unit 33.

The power save block included in the embodiment of the present invention may be operated at a low frequency or disabled in response to the power down mode, thereby reducing power consumption. The power control block included in the embodiment of the present invention may be operated to bias a low voltage or disabled in response to the power down mode, thereby reducing power consumption. Furthermore, the multiplexer 48 may block the source driving signal OUT from being transmitted to the display panel, thereby reducing power consumption.

That is, according to the power control signals S1 to S6 to which the bias option data BD is applied, the shift register 50, the data register 38, or the latch 40 which performs a digital operation may be operated at a low frequency obtained by masking the clock signal or disabled to reduce power. Furthermore, according to the power control signals S1 to S6 to which the bias option data BD is applied, the receiver 34, the gamma buffer 68, the output buffer 46, and the bias section 66, which perform an analog operation, may be operated to bias a low voltage or disabled or floated to reduce power. The multiplexer 48 may block the source driving signal OUT from being transmitted to the display panel, thereby reducing power consumption.

When operating in the power down mode, the receiver 34 may have difficulties in receiving input data INPUT DATA. At this time, the respective parts of the source driver 12 may be operated according to the bias option data BD which is recognized before they are operated in the power down mode.

Furthermore, the source driver 12 may perform the power down mode for the output buffer 46 and the multiplexer 48 included in the output unit 45, in response to the mode select data MD or the mode control signal PIN which is enabled at a preset time regardless of the input data INPUT DATA. Furthermore, when entering the power down mode, the source driver 12 may control the source driving signal OUT to maintain the previous data regardless of the input data INPUT DATA or set the source driving signal OUT in a floating state. That is, the source driver 12 may block the output of the source driving signal OUT corresponding to the current input data INPUT DATA, and determine the state of the source driving signal OUT regardless of the current input data INPUT DATA. Thus, the current consumption for refresh in the display panel can be regulated to reduce power consumption.

Referring to FIGS. 2 to 5, the operations corresponding to the respective cases in the embodiment of the present invention will be described as follows.

Figure 2:
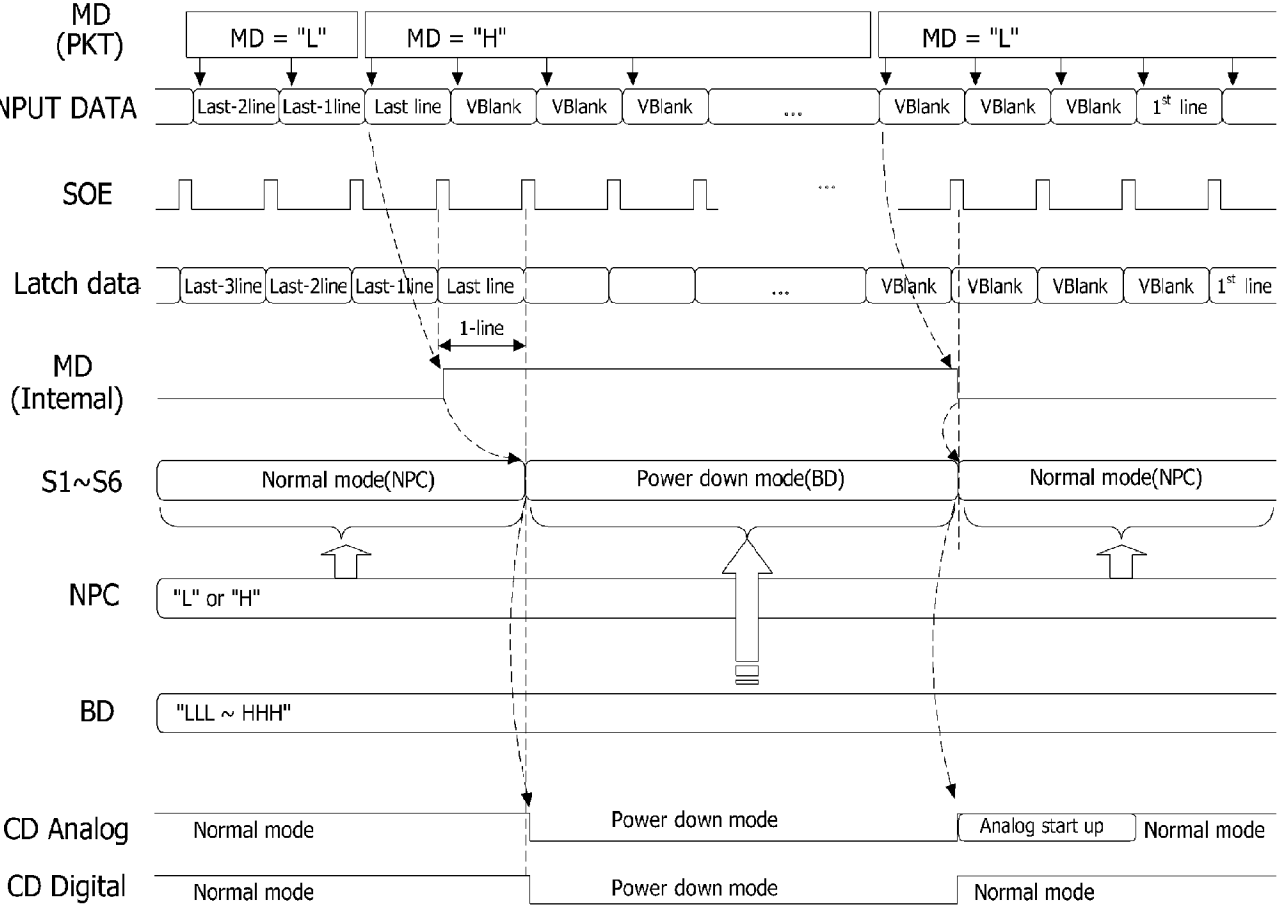
FIG. 2 is a waveform diagram for describing a power down mode based on mode select data which is enabled at the last active line.

FIG. 2 illustrates that the power down mode is performed in response to a vertical blank period, the mode select data MD contained in the power control information PKT is activated ("H") for the power down mode, and the start of the power down mode is synchronized with the time at which the last active line Last line is started before vertical blank periods VBlank are started. In FIG. 2, the mode control signal PIN is not applied.

In FIG. 2, MD (PKT) represents mode select data contained in power control information PKT, and SOE represents a source enable signal provided from the control logic section 64. The source enable signal SOE may be contained in the logic control signal LCS and transmitted to the respective units or separately transmitted to the output buffer 46 and the multiplexer 48. Furthermore, Latch data represents a data signal DATA stored in the latch 40, and MD (Internal) represents mode select data transmitted to the power controller 62 from the packet register 60. Furthermore, CD Analog represents a signal for distinguishing the mode of the power control block to process an analog signal, and CD Digital represents a signal for distinguishing the mode of the power save block to process a digital signal.

Referring to FIG. 2, in the normal mode, data DATA of active lines Last-2line and Last-1line included in a frame may be converted into the source driving signal OUT by the interface unit 30, the signal processing unit 32, the output unit 45, and the bias unit 33. At this time, the power controller 62 may determine whether the current state is the normal mode according to the normal mode select data NPT in an active state, and provide the power control signals S1 to S6 for the normal mode.

FIG. 2 illustrates the state in which the high-level mode select data MD is included in the last active line Last line of the input data INPUT DATA. Thus, while the activated mode select data MD(PKT) of the last active line Last line is recovered by the decoder 36 and transmitted to the power controller 62, the performance of the power down mode may be delayed.

The power controller 62 may provide the power control signals S1 to S6 for performing the power down mode according to the activated mode select data MD(Internal), and the power options of the power control signals S1 to S6 may be set according to the bias option data BD.

That is, the embodiment of the present invention may perform an operation of consuming a large amount of current according to the normal mode select data NPC during the normal mode, and perform an operation of consuming a small amount of current corresponding to the bias option data BD during the power down mode.

The above-described power down mode may be maintained until the mode select data MD(Internal) is deactivated or the vertical blank period is ended. The time at which the vertical blank period is ended may be set to a predetermined position before the first horizontal active line ($1^{st}$ line) is started. When the vertical blank period defined as described above is ended, the mode select data MD(Internal) may be deactivated. Then, the embodiment of the present invention may perform the normal mode in which a large amount of current is consumed, according to the normal mode select data NPC. At this time, between the time at which the mode select data MD(PKT) included in the input data INPUT DATA is deactivated and the time at which the vertical blank period is ended, a delay time required for the recovery operation performed by the decoder 36 may be applied.

The embodiment of the present invention may consume a small amount of current during the power down mode, and thus suppress excessive current consumption.

Figure 3:
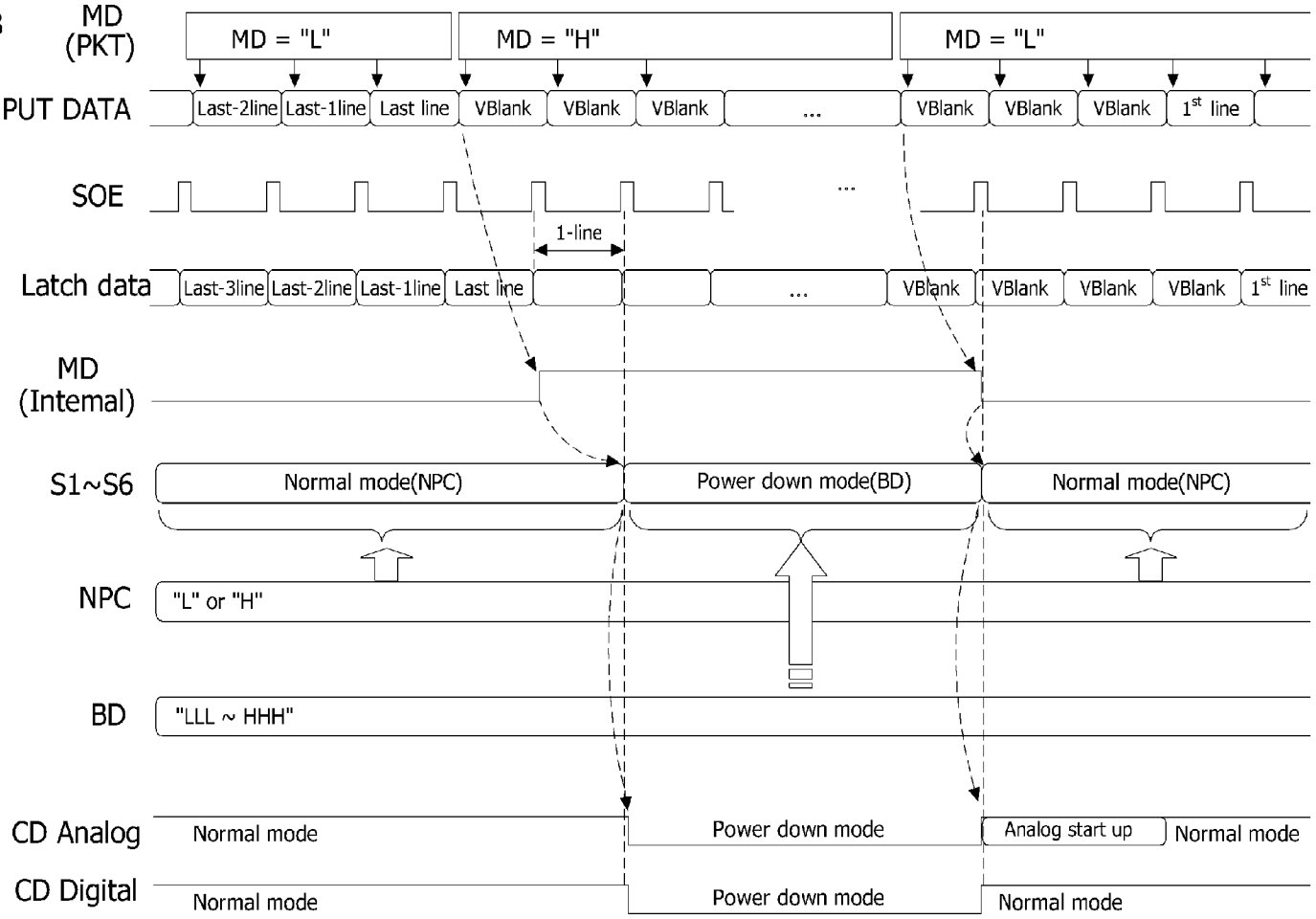
FIG. 3 is a waveform diagram for describing a power down mode based on mode select data which is enabled at a first vertical blank period.

FIG. 3 is a waveform diagram for describing the power down mode in which the mode select data MD is activated (H) at a first vertical blank period. FIG. 3 is almost the same as FIG. 2, except for the time at which the mode select data MD is activated. Thus, the detailed descriptions thereof are omitted herein. In FIG. 2, the mode select data MD(PKT) is activated at the start time of the last active line Last Line. In FIG. 3, the mode select data MD(PKT) is activated at the start time of the first vertical blank period.

Figure 4:
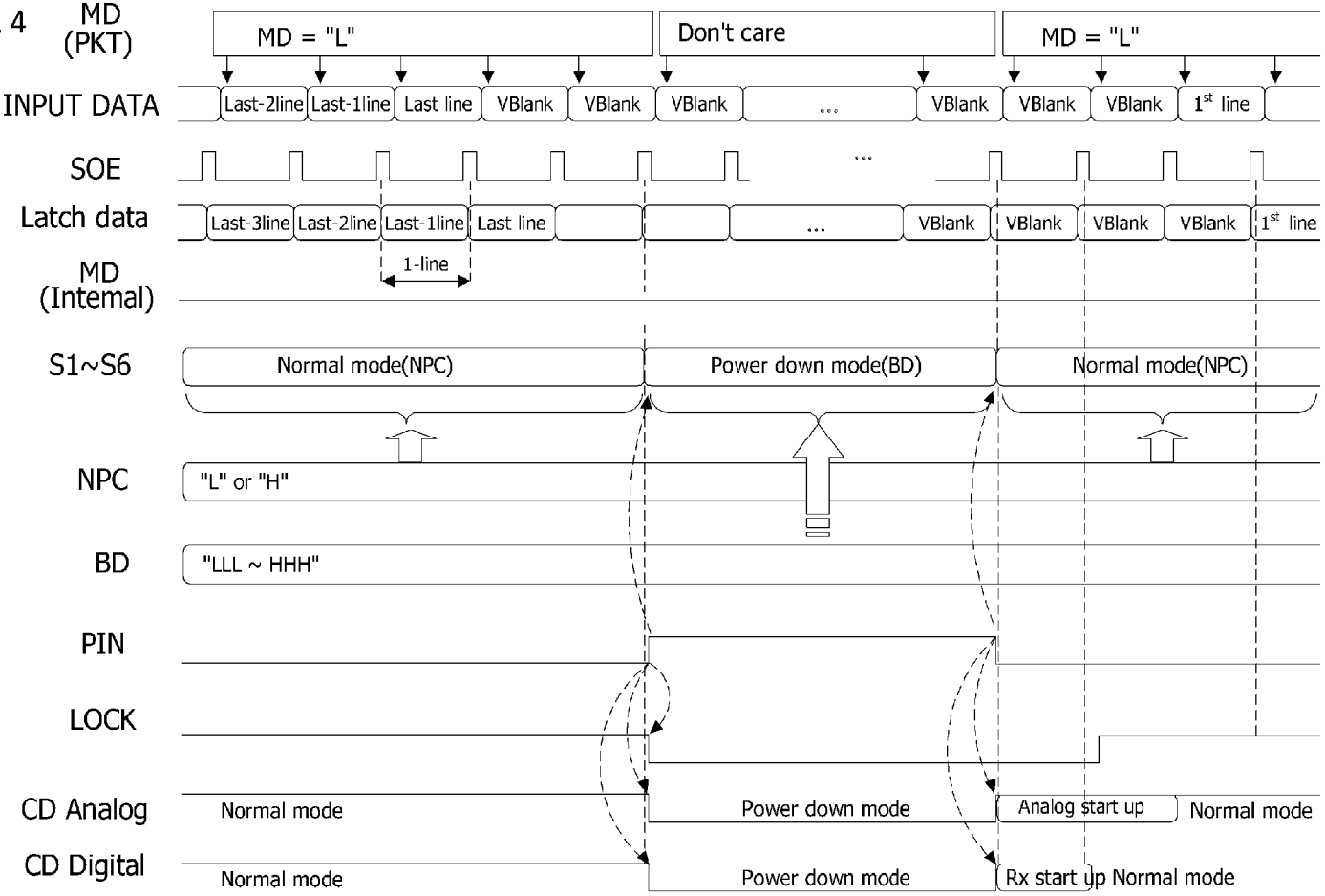
FIG. 4 is a waveform diagram for describing a power down mode based on a mode control signal.

FIG. 4 is a waveform diagram for describing the power down mode according to the mode control signal.

As illustrated in FIG. 4, the normal mode may be performed during active lines Last-2line and Last-1line and some vertical blank periods VBlank which are included in the input data INPUT DATA. Furthermore, during the normal mode, the power controller 62 may determine whether the current state is the normal mode, according to the normal mode select data NPC in an active state, and provide the power control signals S1 to S6 for the normal mode.

The mode control signal PIN may have a higher priority than the mode select data MD. That is, when the mode control signal PIN is activated, the power down mode may be started regardless of the mode select data MD.

The mode control signal PIN may be provided from the mode controller 24 without passing through the recovery process. Thus, the power controller 62 may provide the power control signals S1 to S6 for performing the power down mode at the same time as the mode control signal PIN is activated, and the power options of the power control signals S1 to S6 may be set according to the bias option data BD.

At this time, the receiver 34 and the decoder 36 of the interface unit 30 may be disabled in response to the power down mode. Then, the lock state of the clock signal CLK may be released. The lock state of the clock signal CLK may be defined as a signal which is activated when the clock signal is normally recovered. As the lock signal transitions to an inactive state, the lock state may be released.

The above-described power down mode may be maintained until the activation of the mode control signal PIN is maintained or the vertical blank period is ended. When the vertical blank period is ended, the mode control signal PIN may be deactivated. Then, the embodiment of the present invention may perform the normal mode in which a large amount of current is consumed, according to the normal mode select data NPC. At this time, the power controller 62 may provide the power control signals S1 to S6 for performing the normal mode, after the mode control signal PIN is deactivated.

Furthermore, the interface unit 30, the signal processing unit 32, and the output unit 45 may set the clock signal CLK to the lock state before the normal mode is activated, and need periods (Rx start up and Analog start up) which are required for recovering and transmitting the data and the clock signal. Furthermore, the lock state of the clock signal CLK may be set at the above described initial periods, and thus the lock signal LOCK may be activated. The interface unit 30, the signal processing unit 32, and the output unit 45 may be operated in the normal mode after the initial periods.

The embodiment of the present invention may perform the power down mode according to the mode control signal PIN, and consume a small amount of current during the power down mode, thereby preventing excessive current consumption.

Figure 5:
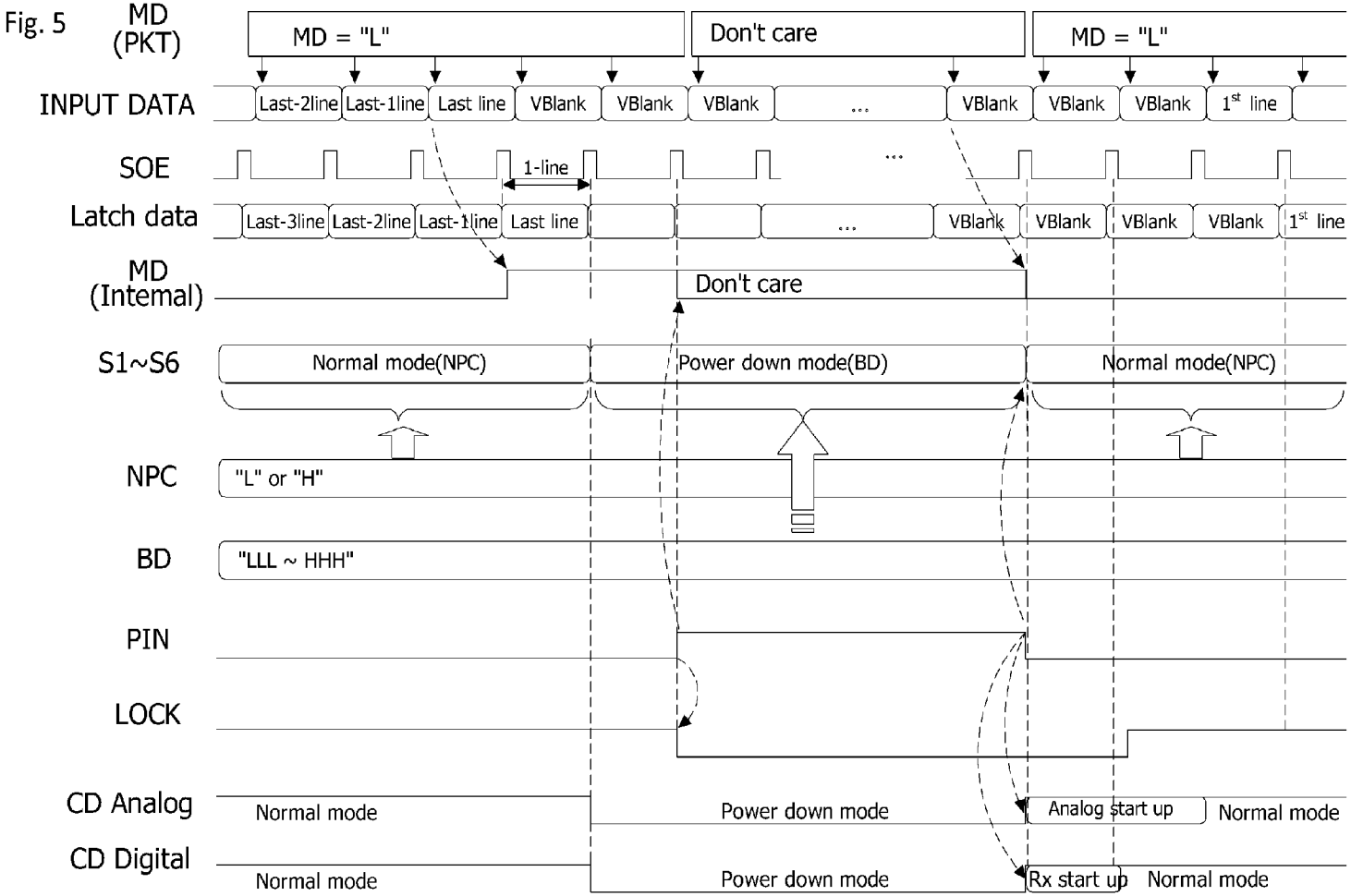
FIG. 5 is a waveform diagram for describing a power down mode based on mode select data and a mode control signal.

FIG. 5 is a waveform diagram for describing the power down mode based on the mode select data MD and the mode control signal PINT.

The embodiment of the present invention may perform the power down mode based on an interrupt by the mode control signal PIN, while the power down mode is performed according to the mode select data MD as illustrated in FIG. 5.

The embodiment of the present invention may perform the power down mode according to the mode select data MD(PKT) which is activated at the time at which the last active line Last line on the input data INPUT DATA is started as illustrated in FIG. 5. Since the power down mode based on the mode select data MD(PKT) included in the input data INPUT DATA can be described with reference to FIG. 2, the redundant descriptions thereof are omitted herein.

Furthermore, the power down mode based on the mode select data MD (PKT or Internal) of FIG. 5 may be interrupted as the mode control signal PIN is activated. That is, when the mode control signal PIN is activated, the embodiment of the present invention may ignore the mode select data MD, and perform the power down mode according to the mode control signal PIN. The case in which the power down mode is performed by an interrupt of the mode control signal PIN can be described with reference to FIG. 4. Thus, the detailed descriptions thereof are omitted herein.

The embodiment of the present invention may provide an operation capable of performing the power down mode using the mode control signal PIN as well as the mode select data MD. Thus, since the embodiment of the present invention can perform the power down mode using various power operations, the extension for the power options can be provided.

As described above, the embodiment of the present invention may perform the power down mode according to various power options. Furthermore, the embodiment of the present invention can improve current consumption in response to a vertical blank period, a horizontal blank period, a state in which the load of the display panel is maintained at a preset value or less, a state in which a current supplied to the display panel is maintained at a preset value or less, and a state in which the resolution is maintained at a preset value or less.

Furthermore, the embodiment of the present invention may perform the power down mode described with reference to FIGS. 2 to 5 according to the mode select data MD and the mode control signal PIN which are enabled at a preset time regardless of the input data INPUT DATA.

In this case, the source driver 12 may block output of the source driving signal OUT corresponding to the current input data INPUT DATA in response to the power down mode, and determine the state of the source driving signal OUT regardless of the current input data INPUT DATA. Thus, as the current consumption for refresh in consideration of the leakage characteristic of the cell current of the display panel is regulated, the power consumption can be reduced.

In accordance with the embodiments of the present invention, the source driver may provide the power down mode in which a small amount of current is used, and provide various power options corresponding to the power down mode, thereby reducing power consumption.

Furthermore, the source driver may perform the power down mode in which a smaller amount of current is consumed than a normal mode in which an active line for expressing an image is driven, in response to a state in which the display device can be driven by a small amount of current, such as a vertical blank period, a horizontal blank period, a state in which the load of the panel is maintained at a preset value or less, a state in which a current supplied to the panel is maintained at a preset value or less, or a state in which resolution is maintained at a preset value or less. As a result, the power consumption of the source driver can be reduced.

Furthermore, the source driver may perform the power down mode when driving the display panel of which the refresh characteristic is improved, thereby reducing unnecessary current consumption for refresh.

While various embodiments have been described above, it will be understood to those skilled in the art that the embodiments described are by way of example only. Accordingly, the disclosure described herein should not be limited based on the described embodiments.

What is claimed is:

1. A source driver comprising:

an interface circuit that recovers data and mode select data from input data;

a signal processing circuit that outputs an analog voltage corresponding to the data and use a gamma voltage to generate the analog voltage;

an output circuit that outputs a source driving signal corresponding to the analog voltage;

a bias circuit that provides a driving voltage required for the operations of the interface circuit, the signal processing circuit, and the output circuit, and provide the gamma voltage to the signal processing circuit; and a control circuit that provides a power control signal for distinguishing between a normal mode and a power down mode consuming a lower current than the normal mode, by referring to one or more of the mode select data and a mode control signal provided from outside, wherein one or more of the interface circuit, the signal processing circuit, the output circuit, and the bias circuit perform the power down mode corresponding to the power control signal.

2. The source driver of claim 1, wherein one or more of the mode select data and the mode control signal are provided to control the power down mode in response to any one of a vertical blank period, a horizontal blank period, a state in which the load of a display panel is maintained at a preset value or less, a state in which a current supplied to the display panel is maintained at a preset value or less, and a state in which resolution is maintained at a preset value or less.

3. The source driver of claim 1, wherein the input data comprises bias option data defining a power option of the power down mode, the interface circuit recovers the bias option data from the input data, and the control circuit provides the power control signal corresponding to the bias option data.

4. The source driver of claim 1, wherein the control circuit provides the power control signal for the power down mode regardless of the value of the mode select data, when the power down mode is enabled according to the mode control signal.

5. The source driver of claim 1, wherein one or more of the interface circuit, the signal processing circuit, the output circuit, and the bias circuit are operated at a lower driving voltage than in the normal mode or disabled in response to the power down mode.

6. The source driver of claim 1, wherein one or more of the interface circuit and the signal processing circuit are operated at a lower frequency than in the normal mode or disabled in response to the power down mode.

7. The source driver of claim 1, wherein the interface circuit comprises:

a receiver that outputs an interface signal corresponding to the input data; and a decoder that recovers control information containing the data, a clock signal, and the mode select data using the interface signal, and the receiver is operated at a lower driving voltage than in the normal mode or disabled in response to the power control signal.

8. The source driver of claim 1, wherein the signal processing circuit comprises:

a data register that stores the data signal;

a latch that latches the data signal outputted from the data register on a line basis; and a shift register that provides a latch control signal for controlling transmission of the data signal from the data register to the latch, and the data register, the latch, and the shift register are operated at a low frequency obtained by masking a clock signal or disabled in response to the power control signal.

9. The source driver of claim 1, wherein the bias circuit comprises:

a gamma buffer that provides the gamma voltage; and a bias section that provides a driving voltage for the interface circuit and the signal processing circuit and a gamma bias voltage for the gamma buffer, and one or more of the gamma buffer and the bias section are operated at a lower driving voltage than in the normal mode or disabled in response to the power control signal.

10. The source driver of claim 1, wherein the control circuit comprises:

a packet register that stores control information containing the mode select data provided from the interface circuit; and a power controller that provides the power control signal by referring to one or more of the mode control signal and the mode select data stored in the packet register.

11. The source driver of claim 1, wherein the output circuit performs the power down mode according to one or more of the mode select data and the mode control signal which are enabled at a preset time regardless of the input data.

12. The source driver of claim 11, wherein the output circuit comprises an output buffer, and the output buffer performs any one of a state in which a previous value is maintained and a floating state in response to a power option of the power down mode.

13. The source driver of claim 11, wherein the output circuit comprises a multiplexer, and the multiplexer blocks an output of the source driving signal in response to the power down mode.

14. A source driver comprising:

an interface circuit that recovers data and mode select data from an interface signal corresponding to input data;

a power save circuit that performs a digital operation for data transmission corresponding to the input data;

a power control circuit that generates an analog voltage by converting a digital signal provided as a result of the digital operation, and perform an analog operation for generating a source driving signal using the analog voltage;

a packet register that stores control information containing the mode select data, wherein the control information is recovered from the input data received from a timing controller; and a power controller that provides a power control signal for performing a power down mode by referring to one or more of a mode control signal and the mode select data stored in the packet register, wherein one or more of the interface circuit, the power save circuit, and the power control circuit perform the power down mode consuming lower power than a normal mode, according to the power control signal, wherein the interface circuit comprises a receiver, wherein the receiver outputs the interface signal corresponding to the input data, and wherein the receiver is operated at a lower driving voltage than in the normal mode or disabled in response to the power control signal.

15. The source driver of claim 14, wherein the power control circuit sets the mode control signal to have a priority for performing the power down mode regardless of the value of the mode select data, when the power down mode is enabled in response to the mode control signal.

16. The source driver of claim 14, wherein the power control circuit comprises an output circuit that generates and output the source driving signal in response to the analog voltage, and the output circuit performs the power down mode according to one or more of the mode select data and the mode control signal which are enabled at a preset time regardless of the input data, in response to the power down mode.

17. The source driver of claim 16, wherein the output circuit comprises an output buffer, and the output buffer performs any one of a state in which a previous value is maintained and a floating state, in response to a power option of the power down mode.

18. The source driver of claim 16, wherein the output circuit comprises a multiplexer, and the multiplexer blocks an output of the source driving signal in response to the power down mode.

19. The source drive of claim 14, wherein the interface circuit further comprises:

a decoder that recovers the control information containing the data, a clock signal, and the mode select data using the interface signal.

* * * * *